US005324903A

United States Patent [19]

Moulton

[11] Patent Number: 5,324,903

[45] Date of Patent: Jun. 28, 1994

[54] ARM SWITCH ASSEMBLY

[75] Inventor: Joseph L. Moulton, Mishawaka, Ind.

[73] Assignee: Miles Inc., Elkhart, Ind.

[21] Appl. No.: 996,681

[22] Filed: Dec. 24, 1992

[51] Int. Cl.[5] ..... H01H 3/42

[52] U.S. Cl. ..... 200/573; 200/6 B; 200/6 BA; 200/551

[58] Field of Search ..... 200/533, 547, 548, 549, 200/550, 573, 574, 431, 438, 436, 283, 551, 511, 276.1, 276, 517, 345, 262, 264, 265, 6 R, 6 B, 6 BA

[56] References Cited

U.S. PATENT DOCUMENTS

| | | | |
|---|---|---|---|
| 3,015,002 | 12/1961 | Laviana | 200/283 X |
| 4,063,204 | 12/1977 | McFarlin | 200/288 X |
| 4,418,257 | 11/1983 | Muller et al. | 200/516 X |
| 4,540,859 | 9/1985 | Lemmer | 200/573 X |
| 4,659,879 | 4/1987 | Hasegawa | 200/517 X |
| 4,983,788 | 1/1991 | Pardini | 200/551 X |
| 5,047,603 | 9/1991 | Pardini | 200/549 X |

*Primary Examiner*—Glenn J. Barrett
*Attorney, Agent, or Firm*—R. N. Coe

[57] ABSTRACT

An arm switch assembly, for an electrical instrument having a casing and electrical contacts, comprises an elongated insulating body member with a conductive member moved into engagement with and disengagement from the electrical contacts in response to operation of a camming mechanism. The camming mechanism is slidably mounted to the casing and has a cam surface movable between first and second positions. The insulating body member includes first and second ends, and a lateral arm connected to the first end permits the insulating body member to pivot relative to the casing. A cam follower is connected to and extends laterally from the second end of the insulating body member. The cam follower engages the cam surface in the first position and disengages the cam surface in the second position. The conductive member is mounted on the second end of the insulating body member and is positioned adjacent to the electrical contacts. The conductive member engages the electrical contacts in response to movement of the cam surface to the second position and disengages the electrical contacts in response to movement of the cam surface to the first position. A compressive element mounted to the insulating body member biases the conductive member generally toward the electrical contacts.

13 Claims, 3 Drawing Sheets

ARM SWITCH ASSEMBLY

FIELD OF THE INVENTION

The present invention generally relates to an arm switch used in an electrical instrument. More particularly, the present invention relates to an arm switch with a conductive member that engages with electrical contacts of an electrical circuit in response to a camming action to alter the function of an electrical instrument.

BACKGROUND OF THE INVENTION

Advances in electronics has made electrical instruments more compact and more reliable than bulkier, older electrical instruments. Today, electrical instruments that perform a multitude of functions are portable and can be carried on the user's person or conveniently stored at home. Compactibility and reliability are especially important features for an electrical instrument that performs medical measurements, such as a reflectance photometer.

Persons with diabetes use reflectance photometers to monitor the sugar level in their blood. Compact and portable reflectance photometers can be carried by diabetics and allows them to periodically and conveniently monitor their blood.

Reflectance photometers determine the sugar values of a blood sample through color development. The user places a drop of blood onto a chemically treated strip. The strip changes color depending on the sugar concentration of the blood. The user then inserts the strip of paper into the reflectance photometer, and light from a light-emitting diode is reflected onto the colored strip. Reflected light passes through a wavelength filter and strikes a photodetector. The electrical signals from the photodetector are evaluated and the sugar concentration of the blood sample is determined and displayed by the reflectance photometer.

The reflectance photometer has different mode settings essential for providing reliable measurements. In a calibration mode, the reflectance photometer calibrates itself by emitting light from a light-emitting diode onto a white surface instead of the colored strip. In this way, the reflectance photometer compensates for any distortions on the reflector surface or minor defects that could cause incorrect readings. After calibration, a user inserts the chemically treated strip with blood into the reflectance photometer. The reflectance photometer analyzes the color of the strip and gives an accurate reading of the sugar level in the blood sample.

At present, several reflectance photometers use a rubber switch that is compressed by a compression lever to change operation mode. The lever is pivotally mounted at one end to the top cover of the reflectance photometer. When the cover is placed onto the reflectance photometer, the other end of the lever is engaging a cam slide, and the lever is positioned over the rubber switch. To calibrate the reflectance photometer, the user slides the cam slide that forces the lever to compress the rubber switch and engage with electrical contacts on the reflectance photometer's printed circuit board. To determine the sugar level in a blood sample, the user slides the cam slide in the opposite direction that forces the lever to disengage the rubber switch from the electrical contacts on the reflectance photometer's printed circuit board.

This arrangement between the switch and the lever presents a problem. The reflectance photometer manufacturer must install the rubber switch separately from the lever because the lever is mounted to the top cover. The rubber switch must be carefully placed in the proper position on the reflectance photometer's printed circuit board during the manufacture of the reflectance photometer. Many times, the rubber switch can fall off the printed circuit board or become misaligned with the lever, rendering mode switching impossible and the reflectance photometer useless. Even if the rubber switch remains properly positioned, the present rubber switch and lever configuration hampers the smooth operation of the reflectance photometer. The compression of the rubber switch causes a high degree of friction between the cam slide surface and the lever, and this friction prevents the smooth switching of the reflectance photometer into calibration mode.

SUMMARY OF THE INVENTION

The present invention relates to a new and improved arm switch. The switch of the present invention is designed to minimize friction in changing the operation mode of an electrical instrument, enhancing the operation of the instrument. The arm switch of the present invention also removes a step from the manufacturing process of a reflectance photometer that presently requires the placing of a rubber switch onto a printed circuit board of an electrical instrument and the installing of a compression lever adjacent to the rubber switch. The arm switch of present invention utilizes a single switch body with a conductive member that engages with electrical contacts on a printed circuit board in response to the sliding of the cam slide to change the operation mode of a reflectance photometer.

In a preferred embodiment of the present invention, the arm switch is essential for the changing of the operation mode of the reflectance photometer and includes a switch body that is pivotally mounted to a casing of the reflectance photometer. A user changes the operation mode of the reflectance photometer by sliding a cam slide that is also mounted to the casing of the reflectance photometer and that is adjacent to the arm switch. A cam surface with a varying elevation along its length exists on the cam slide. When a user of the reflectance photometer slides the cam slide, the cam surface changes its elevation relative to a cam follower that extends from the switch body and contacts the cam surface. The cam surface causes the cam follower to change position relative to the cam surface. As the cam follower follows the cam surface, the switch body pivots and changes position according to the cam surface. A conductive member that is mounted on the switch body engages or disengages from electrical contacts located on the printed circuit board of the reflectance photometer, depending on the position of the switch body. When the user slides the cam slide to a calibration position, the cam surface is at an elevated position relative to the cam follower, and the conductive member is disengaged from the electrical contacts because the switch body is also in an elevated position. When the user slides the cam slide to a read sample position, the cam surface moves to a lower point relative to the cam follower, and the conductive member engages with the electrical contacts because the switch body is at its lowest position. A compressive member is also mounted on the switch body and is in engagement with the reflectance photometer casing. The compressive member applies a force upon the switch body in order to stabilize the switch body from misalignment and for smooth operation.

The arm switch of the present invention minimizes the friction that existed in the prior art between the cam slide surface and the compression lever when the lever was compressing the rubber switch. The present invention does not require the compression of a rubber switch to engage electrical contacts on a printed circuit board. As described above, to put the reflectance photometer in calibration mode, a user slides the cam slide in and causes a camming action at the cam surface. The cam surface acts upon the cam follower of the switch body and raises the switch body, resulting in the disengaging of the conductive member from the electrical contacts on the printed circuit board. For read sample mode, the user slides the cam slide out. Alternately, this causes the switch body to lower, resulting in the engaging of the conductive member with the electrical contacts of the printed circuit board. Friction is minimized because the switch body is not require to compress a rubber switch but only has to cause the conductive member to make contact with the electrical contacts.

The arm switch saves a manufacturing step from the prior art because the arm switch comes in one piece and is installed by simply placing the arm switch upon the printed circuit board of the reflectance photometer. The old method requires two manufacturing steps in that the cover manufacturer was required to install the lever to the cover, and properly place the rubber switch upon the printed circuit board. In addition, the rubber switch was susceptible to becoming misaligned during the manufacture of the reflectance photometer, rendering the reflectance photometer useless. The present invention does not cause such manufacturing difficulties.

BRIEF DESCRIPTION OF THE DRAWINGS

The advantages of the present invention will become apparent upon reading the following detailed description and upon reference to the accompanying drawings, in which.

DETAILED DESCRIPTION OF THE PREFERRED EMBODIMENT

Figure 1:
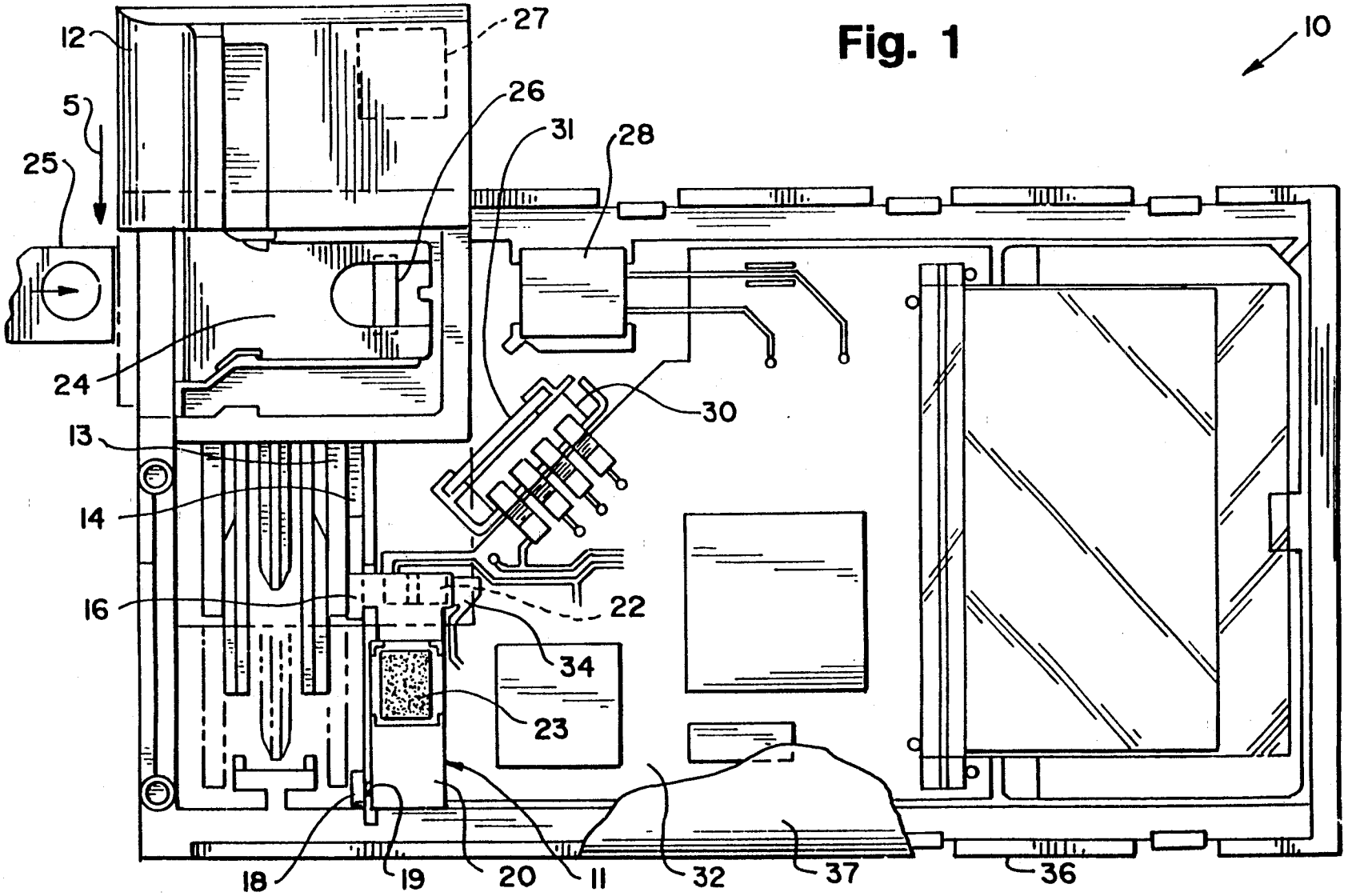
FIG. 1 is a schematic representation of an electrical instrument that includes the arm switch of the present invention.

Referring now to the drawings, and more particularly to FIG. 1, there is illustrated an electrical instrument, generally designated by reference numeral 10, and, in a preferred embodiment of the present invention, the electrical instrument 10 is a reflectance photometer. The instrument 10 includes an arm switch 11 that can be installed within the instrument 10 in one step. The arm switch 11 operates to change the operation mode of the instrument 10. The switch 11 includes a switch body 20 that is pivotally mounted to a casing 36 of the instrument 10 at a pivot notch 19 by a pivot member 18 that extends from the switch body 20. The switch body 20 can be composed of nylon, polycarbonate, butadiene polymers, etc. A user switches the operation mode of the instrument 10 by sliding a cam slide 12 to a desired mode position. The cam slide 12 is movably mounted to the casing 36. The cam slide 12 includes a slide mount 13. The slide mount 13 includes a cam surface 14, and both the slide mount 13 and cam surface 14 are adjacent to the arm switch 11. The cam surface 14 has a varying elevation along its length in order to initiate a camming action with a cam follower 16 that extends from the switch body 20 and contacts the cam surface 14. When a user of the instrument 10 slides the cam slide 12, the cam surface 14 changes its elevation relative to the cam follower 16. As the cam follower 16 follows the cam surface 14, a switch body 20 pivots about the pivot member 18. Depending on the position of switch body 20, a conductive member 22 that is mounted on the switch body 20 engages with or disengages from electrical contacts 34. The electrical contacts 34 can be part of a variety of electrical circuits. In the embodiment discussed here, the electrical contacts 34 are part of a electrical circuit located on a printed circuit board 32 of instrument 10. The conductive member 22 conducts electricity and can be composed of carbon loaded rubber. As discussed below, if the conductive member 22 is disengaged from the electrical contacts 34, the instrument 10 is in calibration mode. But if the conductive member 22 is engaged with the electrical contacts 34, the instrument 10 is in read sample mode.

Figure 2:
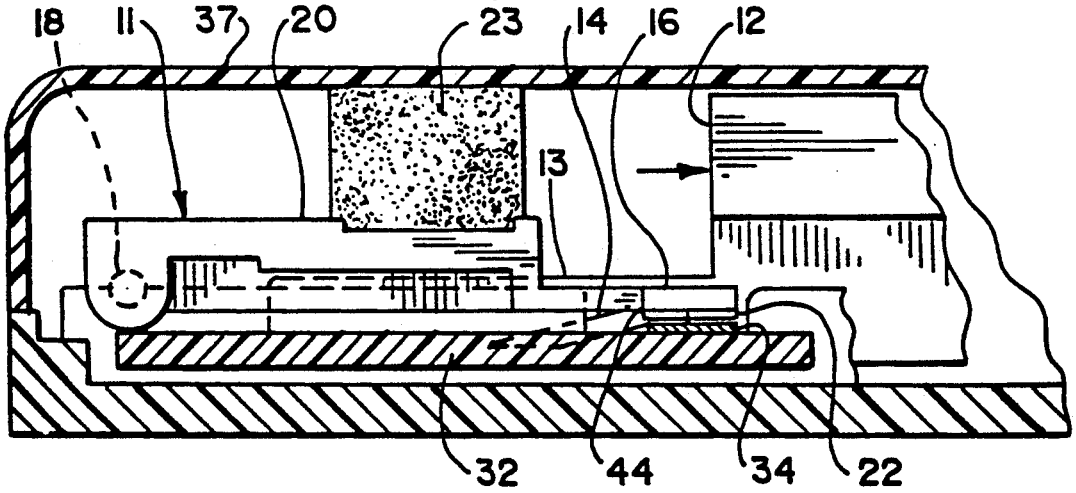
FIG. 2 is a side view of the arm switch of the present invention in which the conductive pad of the arm switch is disengaged from electrical contacts on a printed circuit board.
Figure 3:
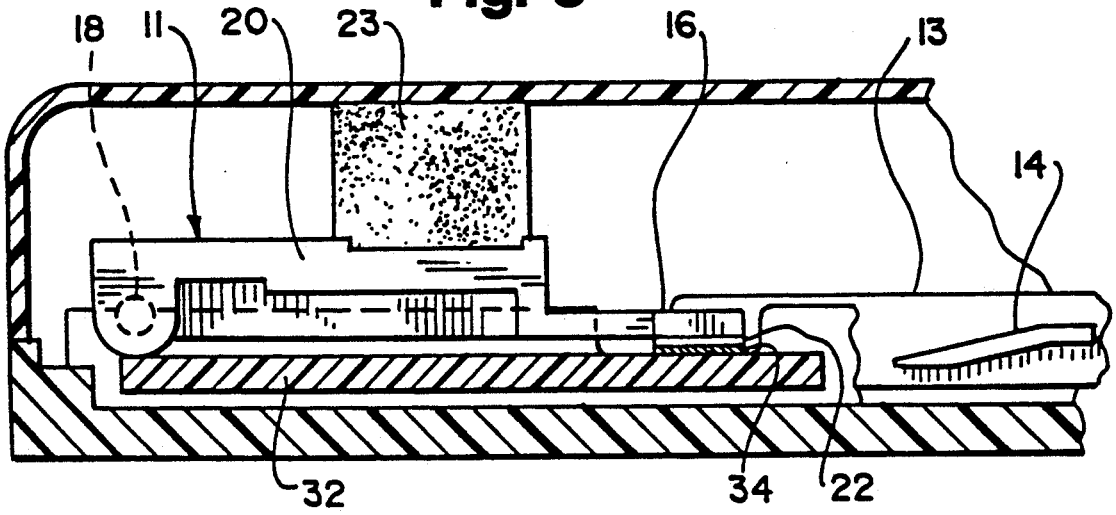
FIG. 3 is a side view of the arm switch of the present invention in which the conductive pad of the arm switch is engaged to electrical contacts on a printed circuit board.

FIG. 2 shows the arm switch 11 with the conductive member 22 disengaged from the electrical contacts 34, placing the instrument 10 in calibration mode. When the cam slide 12 is in a calibration position, the cam follower 16 is on a high portion 44 of cam surface 14. The switch body 20 has pivoted upwards about the pivot member 18 because the cam follower 16 has become elevated. As a result of the pivoting of the switch body 20, the conductive member 22 disengages from the electrical contacts 34 on the printed circuit board 32. A compressive member 23 compresses against a cover 37 and applies a stabilizing force against misalignment and for smooth arm switch operation. The compressive member 23 can be made of silicon rubber, natural rubber, synthetic rubber or a polyurethane foam material.

For calibration mode, as best seen in FIG. 1, cam slide 12 is slid in the direction of arrow 5 and a light-emitting diode 28 emits a light onto a reflector 26 and light is reflected onto a white surface 27. The light reflected from the white surface passes through a wavelength filter 31 and into a photodetector 30. In this way, any distortions or minor defects in the optical components are compensated for by the instrument 10.

After calibration the user inserts a chemically treated blood sample strip 25 into slot 24 of the cam slide 12 as best seen in FIG. 1. To trigger the read sample mode in the instrument 10, the user slides the cam slide 12 to its position in FIG. 1. As best seen in FIG. 1 through FIG. 4, the movement of the cam slide 12 causes the slide mount 13 and the cam surface 14 to move, positioning cam follower 16 in a lower position. When the instrument 10 is in the read sample mode, the cam follower 16 is at its lowest position. The switch body 20 pivots downward about the pivot member 18 under the force of the compressive member 23. Consequently, the downward pivoting of the switch body 20 causes the conductive member 22 to engage with the electrical contacts 34 on the printed circuit board 32. The compressive member 23 decompresses but continues to apply a downward force to the arm switch 11.

Once in the read sample mode, a light-emitting diode 28 emits a light onto reflector 26 and light is reflected from the reflector 26 onto the blood sample strip 25 that has been inserted into slot 24 of the cam slide 12. The light reflected from the sample strip is reflected through a wavelength filter 31 and into the photodetector 30. The instrument 10 analyzes the wavelength of the light from the sample strip and determines the level of sugar in the sample.

Figure 6:
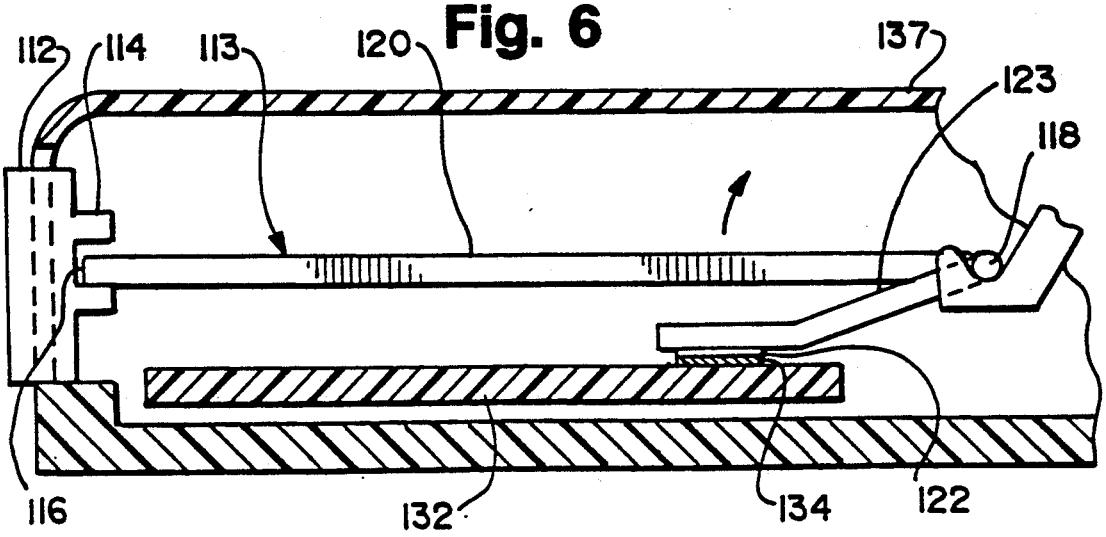
FIG. 6 is a side view of still another embodiment of an arm switch of the present invention.
Figure 4:
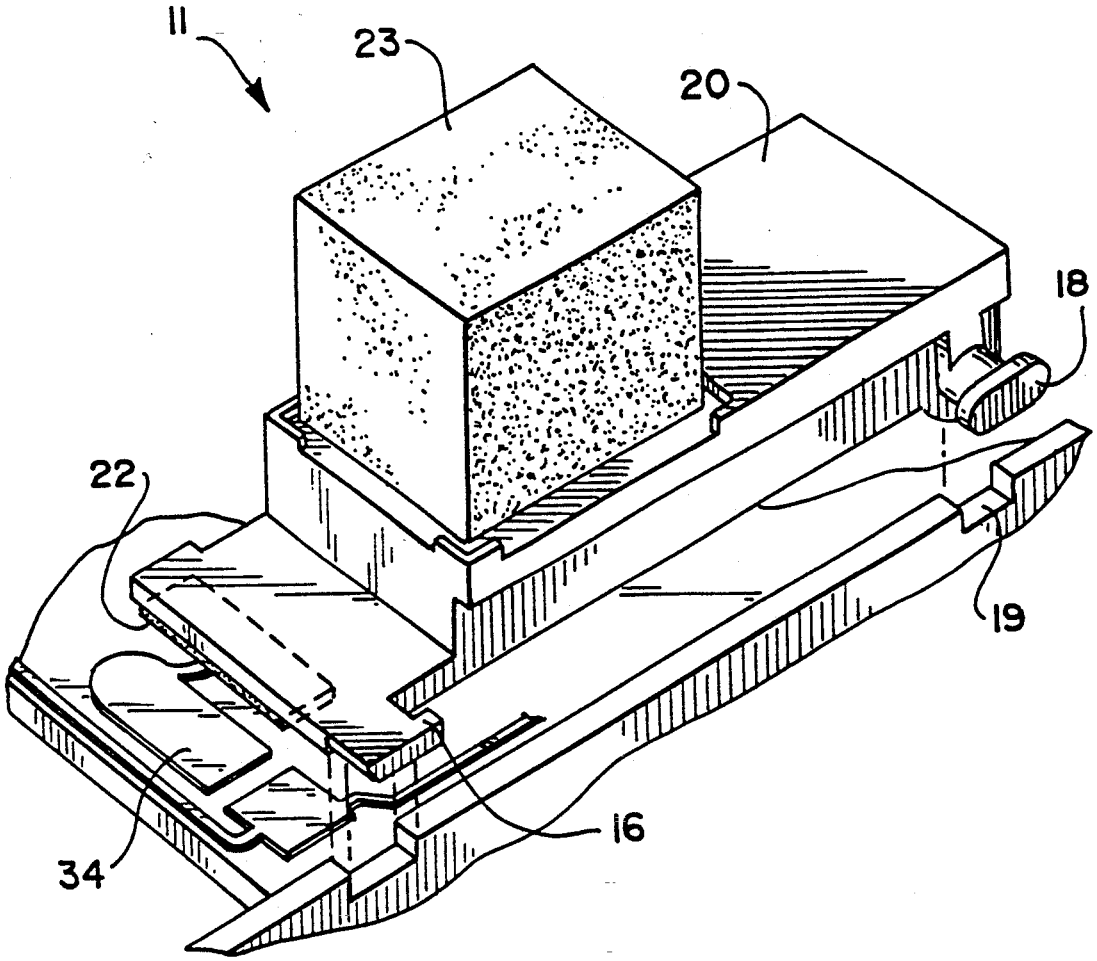
FIG. 4 is a perspective view of an arm switch of the present invention.
Figure 5:
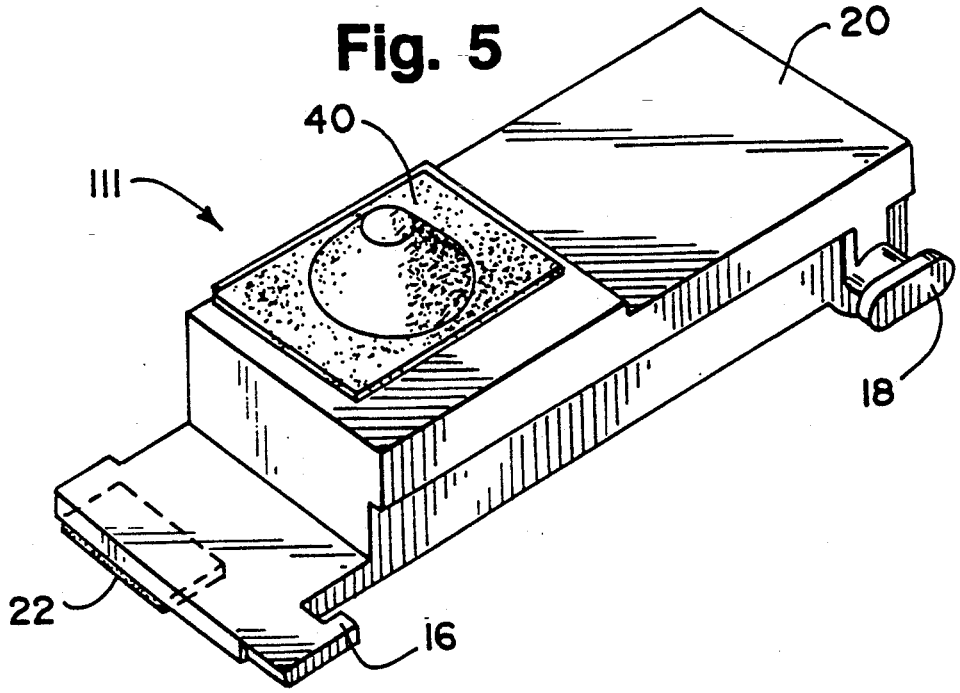
FIG. 5 is a perspective view of another embodiment of the arm switch of the present invention.

FIG. 5 and FIG. 6 illustrate alternative embodiments of an arm switch of the present invention. FIG. 5 illustrates a perspective view of an arm switch, generally designated by the reference numeral 111. The arm switch 111 has an identical structure as arm switch 11 of FIG. 4, but a rubber cone compressive member 40 in arm switch 111 replaces the compressive member 23 of arm switch 11. The rubber button compressive member 40 operates in the same fashion as compressive member 23 of arm switch 11.

FIG. 6 shows another embodiment of the arm switch of the present invention, generally designated by reference numeral 113. The arm switch 113 includes a switch body 120 that pivotally mounts to an instrument casing 137 with pivot member 118 that extends from the switch body 120. As described above, a user switches the operation mode of the instrument by sliding a cam slide 112 to a desired mode position. The cam slide 112 is movably mounted to the casing 137 and is adjacent to the arm switch 113. A cam surface 114 with a varying elevation along its length exists on the cam slide 112. When a user slides the cam slide 112, the cam follower 116 that extends out as part of the switch body 120 moves along the cam surface 114. As the cam follower 116 follows the cam surface 114, switch body 120 pivots about the pivot member 118 and changes position according to the cam surface 114. Depending on the position of switch body 120, a conductive member 122 that is mounted onto the switch body 120 engages or disengages from the electrical contacts 134 located on a printed circuit board 132 of the instrument. The compressive element 123 of the arm switch 113 deflects or compresses toward the switch body during engagement of the conductive member 122 with the electrical contacts 134. The compressive element 123 is in the form of a leaf spring.

The present invention has been described as being used with a reflectance photometer. The present invention, however, can be used with other electrical instruments. Also, the arm switch of the present invention has been described with the above embodiments; but the present invention encompasses other embodiments. For example, the arm switch can have multiple conductive members, multiple cam followers on a jointed switch body or multiple compressive elements with varying designs.

The invention has also been described in terms of making quantitative or qualitative measurements of flucose in whole blood or plasma. It will be understood that, depending on the chemistry employed in a test matrix, other analytes such as cholesterol can be measured. Indeed, the sample employed does not even have to be whole blood or plasma. Any body fluid can be used.

Thus, the arm switch of the present invention and many of its attendant advantages will be understood from the foregoing description and various modifications may be made in the form, construction and arrangement of the parts thereof without departing from the spirit and scope of the invention or sacrificing all of its material advantages, the form described above being merely a preferred or exemplary embodiment thereof.

I claim:

1. An arm switch assembly for an electrical instrument comprising:

a casing having electrical contacts disposed therein;

a camming mechanism slidably mounted to the casing and having a cam surface movable between first and second positions;

an elongated insulating body member pivotally mounted to the casing, said insulating body having a cam follower engaging said camming mechanism;

a conductive member mounted on said insulating body member and positioned adjacent to said electrical contacts, said conductive member engaging said electrical contacts in response to movement of said cam surface to said second position and disengaging said electrical contacts in response to movement of said cam surface to said first position; and a compressive element mounted to said insulating body member and biasing said conductive member generally toward the electrical contacts.

2. The arm switch assembly of claim 1 wherein said insulating body member includes a first end and a second end, said conductive member being mounted on said second end.

3. The arm switch assembly of claim 1 wherein said insulating body member includes a first end and a second end, said cam follower and said conductive member being mounted on said second end.

4. The arm switch assembly of claim 1 wherein said insulating body member includes a first and second end, said insulating body member being pivotally mounted to the casing at said first end, said cam follower and said conductive member being mounted on said second end.

5. The arm switch assembly of claim 1 wherein said insulating body member includes a first end and a second end, and further including a lateral arm connected to and extending laterally from said first end of said insulating body member, said lateral arm being pivotally mounted to the casing.

6. An arm switch assembly for an electrical instrument having electrical contacts, comprising:

a casing having a pivot notch formed therein;

a camming mechanism slidably mounted to said casing and having a cam surface movable between first and second positions;

an elongated insulating body member including a first end and a second end;

a pivot member connected to and extending from said first end, said pivot member being pivotally mounted within said pivot notch to permit said insulating body member to pivot about said pivot notch;

a cam follower connected to and extending from said second end of said insulating body member, said cam follower engaging said cam surface in said first position and disengaging said cam surface in said second position;

a conductive member mounted on said second end of said insulating body member being adapted to and positioned adjacent to said electrical contacts, said conductive member engage said electrical contacts in response to movement of said cam surface to said second position and being adapted to disengage said electrical contacts in response to movement of said cam surface to said first position; and a compressive element mounted to said insulating body member and adapted for biasing said conductive member generally toward the electrical contacts.

7. The arm switch assembly of claim 6 wherein said compressive element is composed of a material selected from the group consisting of silicon rubber, natural rubber, synthetic rubber, and polyurethane foam.

8. The arm switch assembly of claim 6 wherein said conductive member is composed of carbon loaded rubber.

9. The arm switch assembly of claim 6 wherein said insulating body member is composed of a material selected from the group consisting of nylon, polycarbonate, and butadiene polymers.

10. An arm switch assembly for an electrical instrument having electrical contacts, comprising:

a casing having a linear track formed therein and a pivot notch formed in said casing adjacent to said linear track;

a camming mechanism slidably mounted to said linear track and having a cam surface movable between first and second positions;

an elongated insulating body member having first and second ends;

a lateral arm connected to and extending laterally from said first end of said insulating body member, said lateral arm being pivotally mounted within said pivot notch to permit said insulating body member to pivot about said pivot notch;

a cam follower connected to and extending laterally from said second end of said insulating body member, said cam follower engaging said cam surface in said first position and disengaging said cam surface in said second position;

a conductive member mounted on said second end of said insulating body member and positioned adjacent to the electrical contacts, said conductive member being adapted to engage the electrical contacts in response to movement of said cam surface to said second position and being adapted to disengage the electrical contacts in response to movement of said cam surface to said first position; and a compressive element mounted to said insulating body member and adopted for biasing said conductive member generally toward the electrical contacts.

11. The arm switch assembly of claim 10 wherein said compressive element is made of a material selected from the group consisting of silicon rubber, natural rubber, synthetic rubber, and polyurethane foam.

12. The arm switch assembly of claim 10 wherein said cam surface includes a sloping elevated portion, and wherein said cam follower engages said sloping elevate portion in moving from said second position to said first position.

13. The arm switch assembly of claim 10 wherein said insulating body member is made of a material selected from the group consisting of nylon, polycarbonate, and butadiene polymers.

* * * * *